US008900070B1

(12) United States Patent
Dawson et al.

(10) Patent No.: US 8,900,070 B1
(45) **Date of Patent: *Dec. 2, 2014**

(54) WEIGHTED GOLF CLUB HEAD

(71) Applicant: Callaway Golf Company, Carlsbad, CA (US)

(72) Inventors: Patrick Dawson, San Diego, CA (US); Irina Ivanova, San Diego, CA (US); Bradley C. Rice, Carlsbad, CA (US); Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 91 days.

This patent is subject to a terminal disclaimer.

(21) Appl. No.: 13/797,507

(22) Filed: Mar. 12, 2013

Related U.S. Application Data

(63) Continuation-in-part of application No. 13/788,173, filed on Mar. 7, 2013.

(51) Int. Cl.
*A63B 53/04* (2006.01)
*A63B 53/06* (2006.01)

(52) U.S. Cl.
CPC ..... *A63B 53/047* (2013.01); *A63B 53/06* (2013.01)
USPC ..... 473/329; 473/335; 473/345; 473/346; 473/349

(58) Field of Classification Search
USPC ..... 473/324–350, 287–292, 256
See application file for complete search history.

(56) References Cited

U.S. PATENT DOCUMENTS

| | | | | |
|---|---|---|---|---|
| 3,979,122 | A * | 9/1976 | Belmont | 473/336 |
| 4,826,172 | A * | 5/1989 | Antonious | 473/350 |
| 4,895,371 | A * | 1/1990 | Bushner | 473/336 |
| 5,014,993 | A * | 5/1991 | Antonious | 473/350 |
| 6,077,173 | A * | 6/2000 | Stites | 473/334 |
| 6,554,722 | B2 * | 4/2003 | Erickson et al. | 473/334 |
| 6,923,734 | B2 * | 8/2005 | Meyer | 473/336 |
| 7,744,487 | B2 * | 6/2010 | Tavares et al. | 473/332 |
| 7,771,288 | B2 * | 8/2010 | Gilbert et al. | 473/324 |
| 7,789,771 | B2 * | 9/2010 | Park et al. | 473/332 |
| 7,988,568 | B2 * | 8/2011 | Stites et al. | 473/334 |
| 8,257,195 | B1 * | 9/2012 | Erickson | 473/329 |
| 8,328,661 | B1 * | 12/2012 | Erickson | 473/329 |
| 8,414,420 | B1 * | 4/2013 | Erickson | 473/329 |
| 8,425,346 | B1 * | 4/2013 | Erickson | 473/329 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club head having a center of gravity located at a point close to the face and the sole is disclosed herein. In particular, the golf club head comprises a hollow body including a weight lip and face component, and the weight lip extends from the sole inside the body towards the face component without making contact with the face component. The golf club head is preferably a wood-type or hybrid-type golf club head. In other embodiments, the golf club head, which may be an iron-type golf club head, comprises a weight bar disposed within the hollow body proximate the face component, and the weight bar bridges at least a portion of the sole. The weight bar may be movable within the hollow body to allow for center of gravity adjustment.

20 Claims, 15 Drawing Sheets

WEIGHTED GOLF CLUB HEAD

CROSS REFERENCES TO RELATED APPLICATIONS

The present application is a continuation-in-part of U.S. patent application Ser. No. 13/788,173, filed on Mar. 7, 2013, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having internal weighting that locates the center of gravity of the golf club head close to the face and sole.

2. Description of the Related Art

Golfers often prefer to use golf clubs having low centers of gravity that are also close to the face, which allows for greater control over golf balls during play. There is a need for golf club heads having improved internal weighting.

BRIEF SUMMARY OF THE INVENTION

One aspect of the present invention is an iron-type golf club head comprising a body comprising a top line, a sole, a heel side, a toe side, and a rear cavity, a weight bar comprising a first end and a second end, and a face component, wherein the weight bar is disposed within the rear cavity proximate the face component, wherein the weight bar does not make contact with the face component, and wherein the weight bar bridges at least part of the sole. In some embodiments, the first end may be connected to the heel side and the second end may be connected to the toe side. In alternative embodiment, the first end may be connected to a heel side of the sole and the second end may be connected to a toe side of the sole. In further embodiments, the weight bar may be rotatably connected to the body. In a further embodiment, the weight bar may comprise a pin portion and a weight portion, the pin portion may comprise a heel side end and a toe side end, and the weight portion may be asymmetrically disposed on the pin portion. In some embodiments, the pin portion and the weight portion may not be not integrally formed.

In other embodiments, the weight bar may comprise at least two different materials having different densities. In some embodiments, the face component may be selected from the group consisting of a face plate and a face insert. In still other embodiments, the face component may be integrally formed with the body. In one embodiment, a slot may be disposed between the weight bar and the sole. In another embodiment, the face component may comprise variable thickness.

Another aspect of the present invention is an iron-type golf club head comprising a face component, a body comprising a top line, a sole, a hosel, and a perimeter weighting element, and a weight bar comprising a first end and a second end, wherein the perimeter weighting element comprises a top side, a sole side, a heel side, and a toe side, wherein the perimeter weighting element forms a rear cavity, wherein the weight bar is disposed proximate the rear cavity without making contact with the face component, and wherein the first end of the weight bar is affixed to the heel side of the perimeter weighting element and the second end of the weight bar is affixed to the toe side of the perimeter element such that the weight bar bridges at least part of the sole side and forms a slot proximate the sole. In some embodiments, the face component may be selected from the group consisting of a face plate and a face insert. In other embodiments, the face component may comprise variable thickness.

Some embodiments may further comprise a plurality of pins, each of which may be disposed within the slot and extend between the sole and the weight bar. In other embodiments, the body may be composed of a first steel material, and in further embodiments, the face may be composed of a second steel material that differs from the first steel material. In some embodiments, the weight bar may be integrally formed with the body. In other embodiments, the weight bar may be composed of a plurality of materials. In a further embodiment, at least one of the plurality of materials may be a tungsten alloy.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is generally directed to a golf club head having internal weighting that places the golf club center of gravity (CG) at a point near both the face and the sole of the golf club head. In particular, the present invention is directed to integrally formed weighting in smaller golf club heads, particularly fairway woods and hybrids.

Figure 1:
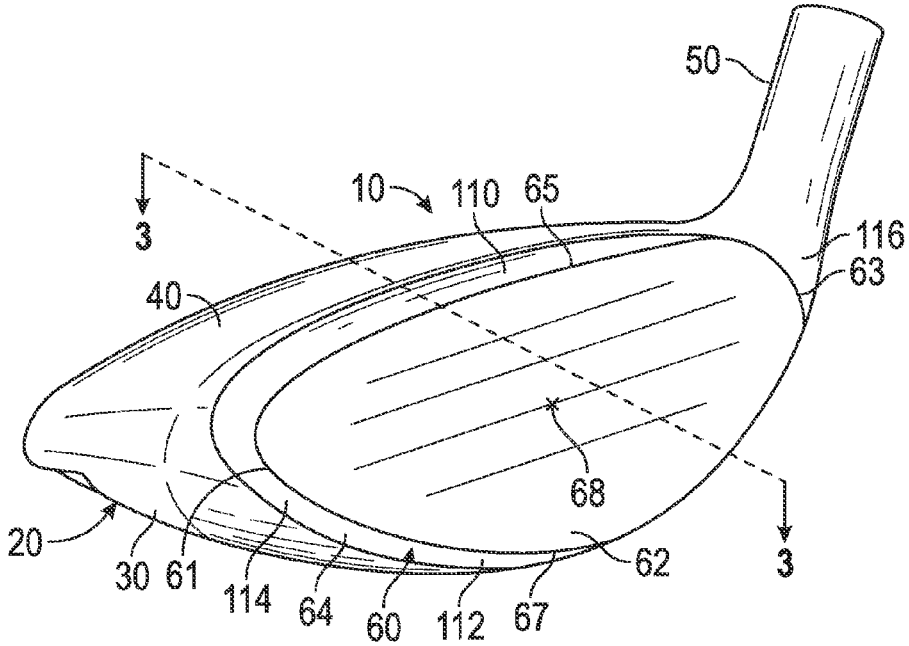
FIG. 1 is a front perspective view of a first embodiment of the present invention.
Figure 2:
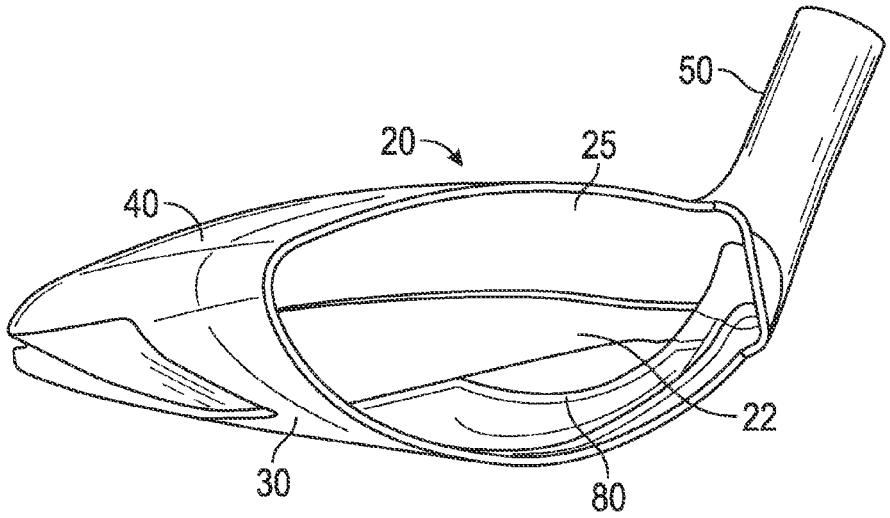
FIG. 2 is front perspective view of the embodiment shown in FIG. 1 without the face component.
Figure 3:
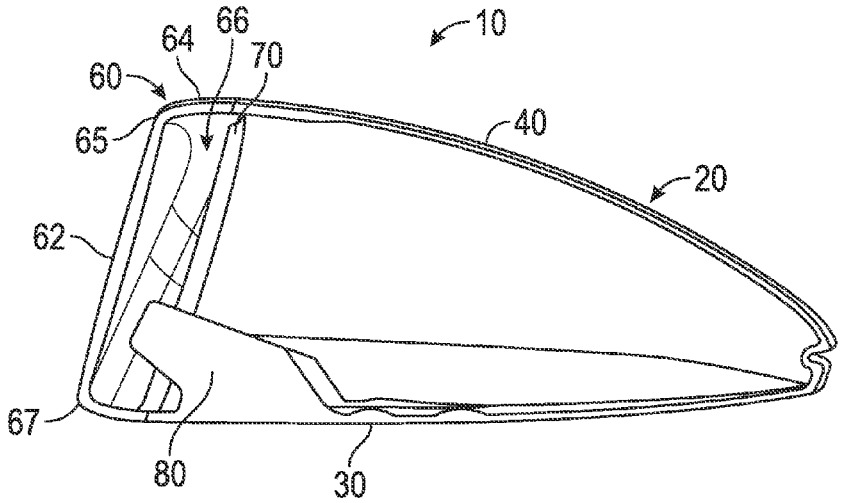
FIG. 3 is a cross-sectional view of the embodiment shown in FIG. 1 along lines 3-3.

A first embodiment of the present invention is shown in FIGS. 1-3. The golf club head 10, which in the first embodiment is a fairway wood head, includes a body 20 having a sole 30, a crown 40, a hosel 50, a cavity 22, and a weight lip 80, and a face component 60 comprising a striking face 62, a return portion 64, and a cavity 66. The striking face 62 preferably has a high characteristic time (CT). The face component 60 preferably is integrally forged from a metal alloy such as 6-4 titanium or stainless steel, while the body 20 preferably is integrally cast from such alloys. In other embodiments, the face component 60 and body 20 may be constructed using different methods and with any materials commonly used for golf club manufacturing. In some embodiments, the face component 60 and body 20 may be integrally formed. The body 20 may further comprise another weighting element, such as a weight pad, a thickened wall area, or a removable weight screw (not shown) to allow a manufacturer or a golfer to adjust any remaining discretionary weight.

Once the body 20 and face component 60 are formed, they are welded together along the opening 25 at the front of the body 20. The weld seam 70, shown in FIG. 3, has a constant, relatively low thickness, preferably approximately 0.031 inch. In order to achieve a low, frontward CG without affecting the weld seam 70, the weight lip 80 is located inside the cavity 22 and proximate the opening 25. This construction avoids creating welding problems, but still allows for discretionary mass to be located mostly low and forward in the golf club head.

The weight lip 80, which preferably is cast into the body 20 but may, in alternative embodiments, be welded or affixed mechanically to the body 20, extends upwards from the sole 30 and protrudes from the opening 25 of the body 20. When the golf club head 10 is assembled, the weight lip 80 extends into the cavity 66 of the face component 60 without making contact with the striking face 62. The weight lip 80 preferably comprises at least 20% of the mass of the body 20, and more preferably 30% of the mass of the body. For example, the golf club head 10 may have the weight distribution shown in Table I.

TABLE I

| Club Part | Weight (in grams) |
|---|---|
| Body 20 | 167 |
| Weight lip 80 | 49 |
| Face component 60 | 38 |
| Total Golf Club Head 10 Weight | 205 |

Figure 4:
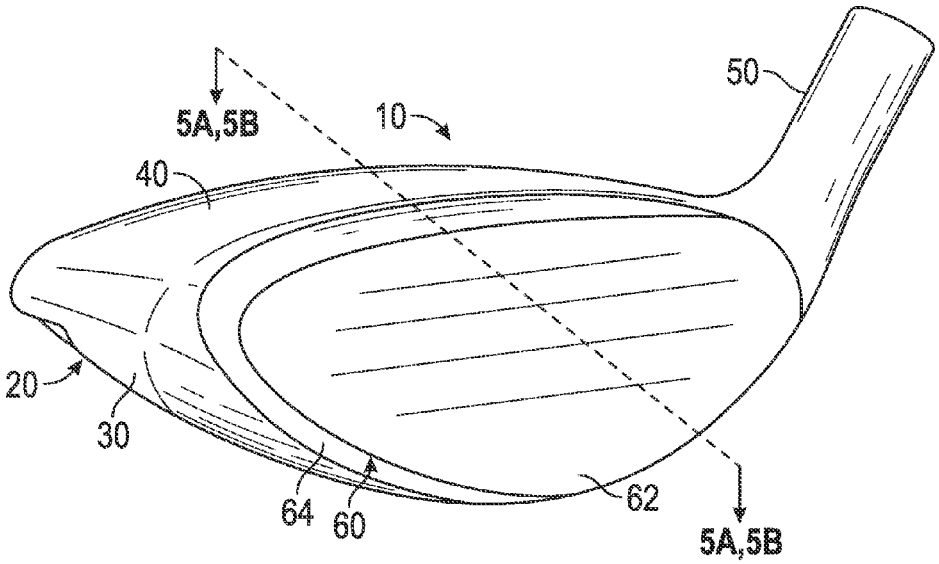
FIG. 4 is a front perspective view of a second embodiment of the present invention.
Figure 5A:
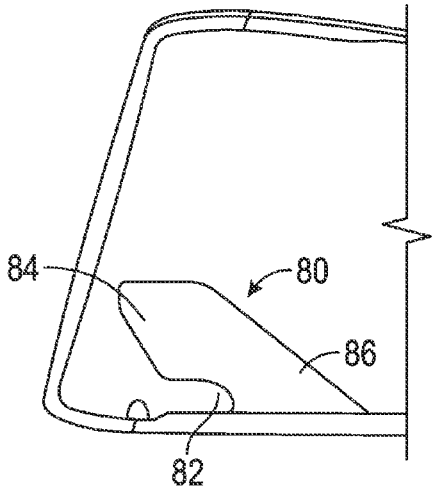
FIG. 5A is a cross-sectional view of the embodiment shown in FIG. 4 along lines 5A,5B-5A,5B.
Figure 5B:
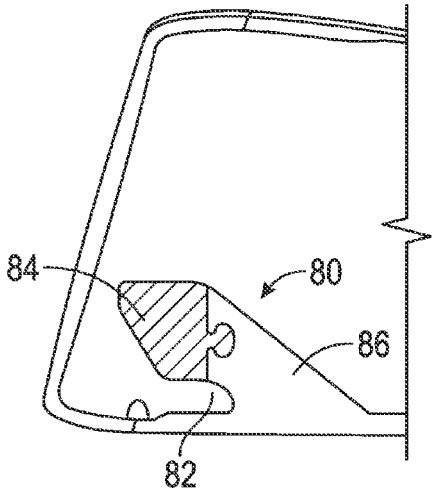
FIG. 5B is a cross-sectional view of an alternative construction of the embodiment shown in FIG. 4 along lines 5A,5B-5A,5B.

In another embodiment, shown in FIGS. 4 and 5A, a groove 82 extends underneath the upper weighted portion 84 of the weight lip 80, creating an overhang construction which reduces the weight of the weight lip 80, and thus the overall weight of the golf club head 10, while still maintaining sufficient weight near the face component 60 to maintain a low, forward CG. In a further embodiment, shown in FIG. 5B, the weight lip 80 is constructed of multiple materials, with the upper weighted portion 84 composed of a higher density material than the rest of the weight lip 80. In particular, the lower support portion 86 of the weight lip 80 is composed of a stainless steel material, while the upper weighted portion 84 is composed of a tungsten alloy and welded or otherwise affixed to the lower support portion 86 of the weight lip 80. In this embodiment, the groove 82 preferably extends slightly further away from the face component 60 and into the lower support portion 86 in order to better counteract the additional weight provided by the higher density upper weighted portion 84.

Figure 6:
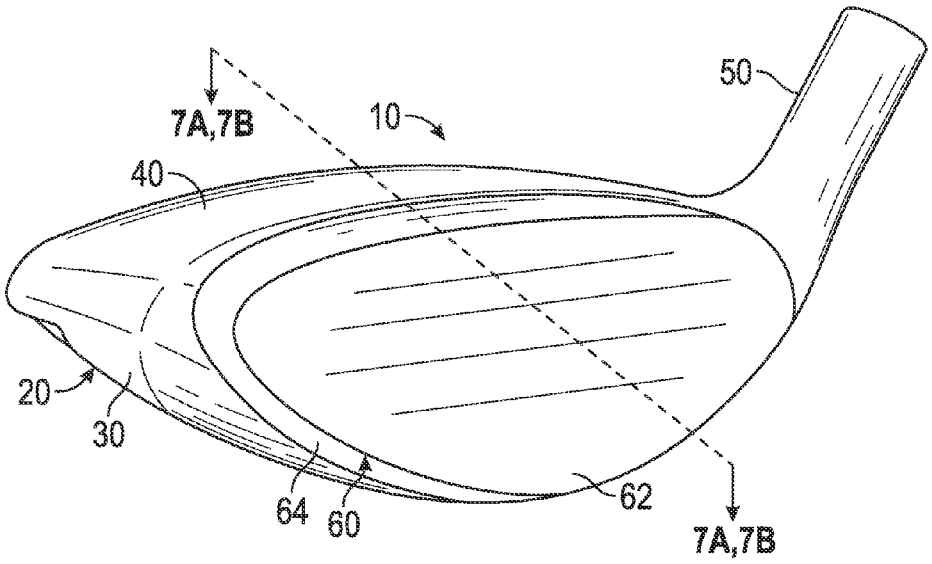
FIG. 6 is a front perspective view of a third embodiment of the present invention.
Figure 7A:
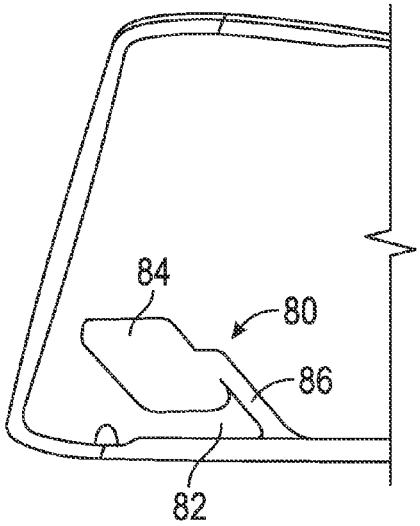
FIG. 7A is a cross-sectional view of the embodiment shown in FIG. 6 along lines 7A,7B-7A,7B.
Figure 7B:
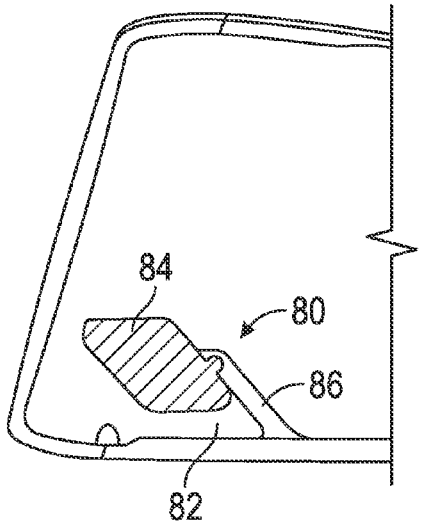
FIG. 7B is a cross-sectional view of an alternative construction of the embodiment shown in FIG. 6 along lines 7A,7B-7A,7B.

As shown in FIGS. 6, 7A, and 7B, in another embodiment the weight lip 80 includes a larger, squarer upper weighted portion 84 and a narrower lower support portion 86, with the groove 82 extending inwards away from the face component 60 and upwards towards the crown 40, such that the groove 82 has a hook-like configuration. As with the embodiment shown in FIG. 5B, in the embodiment shown in FIG. 7B, the upper weighted portion 84 is a separate piece formed of a high density material such as tungsten alloy, which can be welded, glued, or otherwise affixed to the lower support portion 86. This allows for greater customization of the golf club head 10 during manufacture, as mass properties such as CG and moment of inertia can be tailored to the end user by adjusting the material properties of the weight lip 80.

Figure 8:
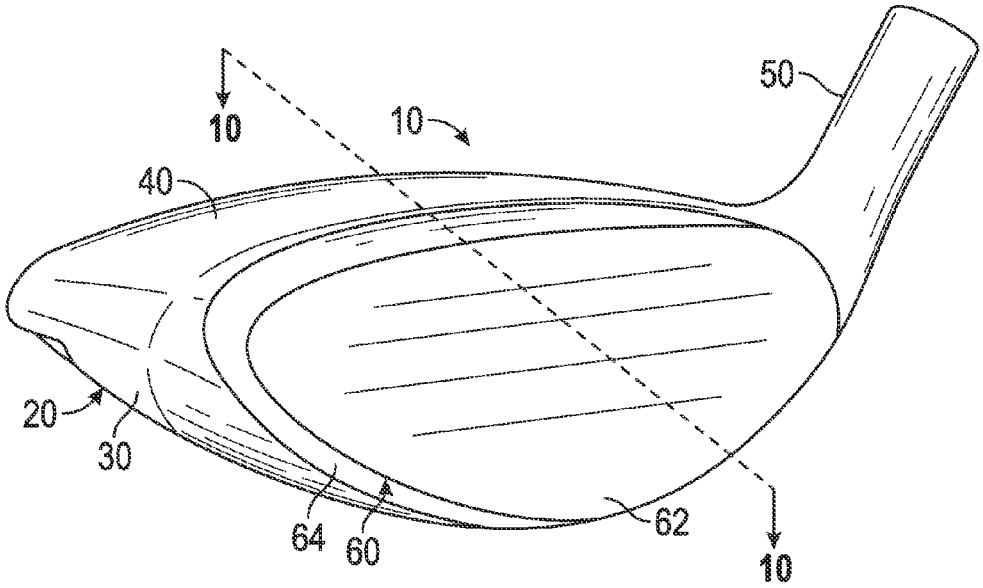
FIG. 8 is a front perspective view of a fourth embodiment of the present invention.
Figure 9:
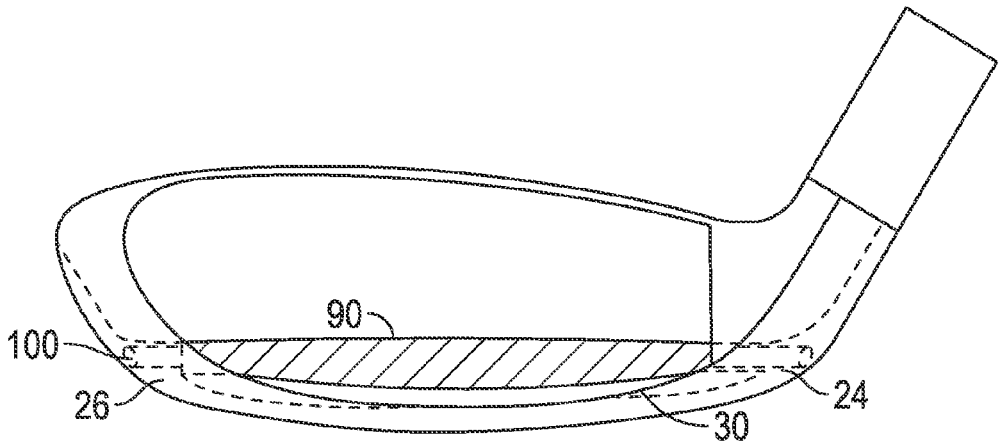
FIG. 9 is a front plan view of the embodiment shown in FIG. 8 without the face component.

In another embodiment of the present invention, shown in FIGS. 8 and 9, the body 20 of the golf club head 10 includes a weight bar 90, which is affixed within the interior of the body 20 only at a heel side 24 and toe side 26 of the golf club head 10, effectively bridging the entire sole 30. This structure allows for activation of the face component 60 and the sole 30 without having an excessive effect on mass properties, as the weight bar 90 acts as a torsion spring during impact of the golf club head 10 with a ball. In some embodiments, the weight bar 90 is integrally cast with the crown 40 and the heel and toe sides 24, 26, and the sole 30 is affixed after the casting is complete, though in alternative embodiments the weight bar 90 may be separately constructed and then affixed within the body 20 at the heel and toe sides 24, 26 via mechanical fasteners, epoxy, welding, brazing, or any other methods known to a person skilled in the art.

Figure 10:
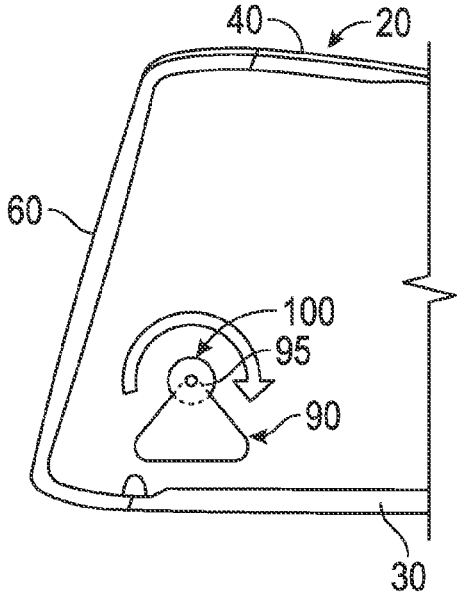
FIG. 10 is a cross-sectional view of the embodiment shown in FIG. 8 along lines 10-10.
Figure 11A:
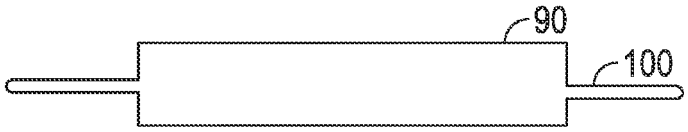
FIGS. 11A-11F are front plan views of weight bar configurations that can be used with the embodiment shown in FIG. 8.
Figure 11B:
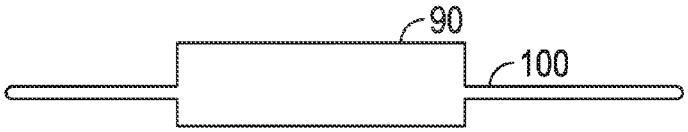
Figure 11C:
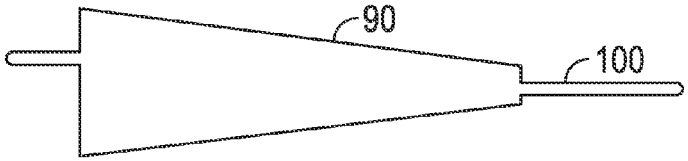
Figure 11D:
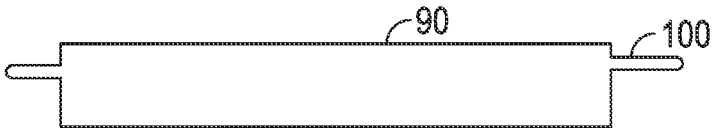
Figure 11E:
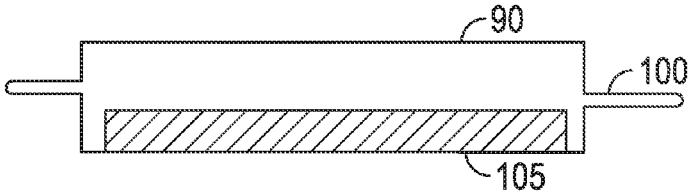
Figure 11F:
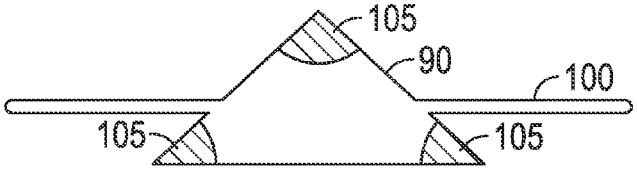

In the embodiment shown in FIG. 10, the weight bar 90 is movably affixed to the heel and toe sides 24, 26 with a pin 100 or other moving element, and the weight bar 90 has a polygonal shape and is affixed to the pin 100 at one edge 95, such that rotating the pin 100 anywhere from 1 to 359 degrees moves the majority of the mass of the weight bar 90 to different locations within the body 20, thus adjusting the location of the golf club head's 10 CG. Different weight bar 90 and pin 100 combinations are shown in FIGS. 11A-F, and may include one or more cross-sectional shapes and/or high-density portions or inserts 105. Once the desired CG location is achieved, the pin 100, and thus the weight bar 90, can be temporarily fixed in place by any means known to a person of ordinary skill in the art, including mechanical fasteners and/or removable adhesives, or permanently fixed in place via techniques such as welding, brazing, and/or the use of permanent adhesives.

Figure 12:
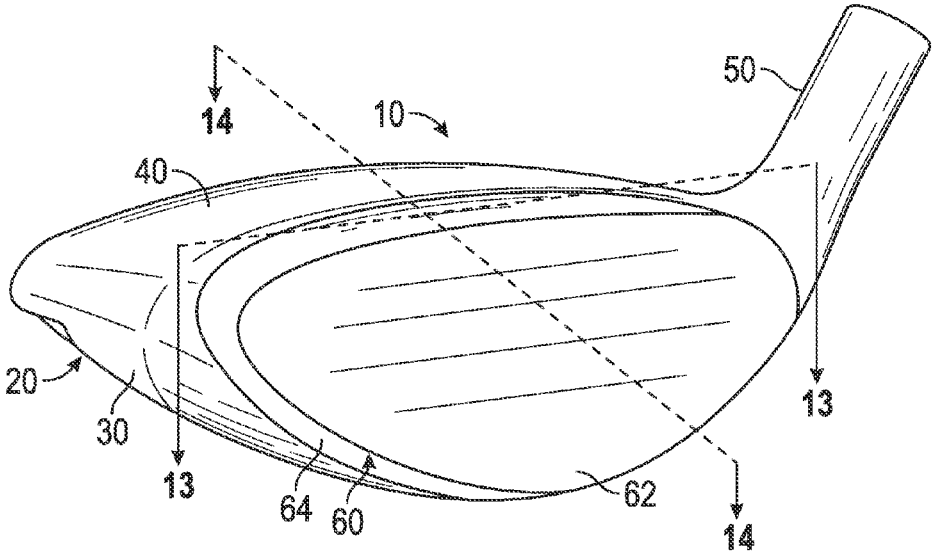
FIG. 12 is a front perspective view of a fifth embodiment of the present invention.
Figure 13:
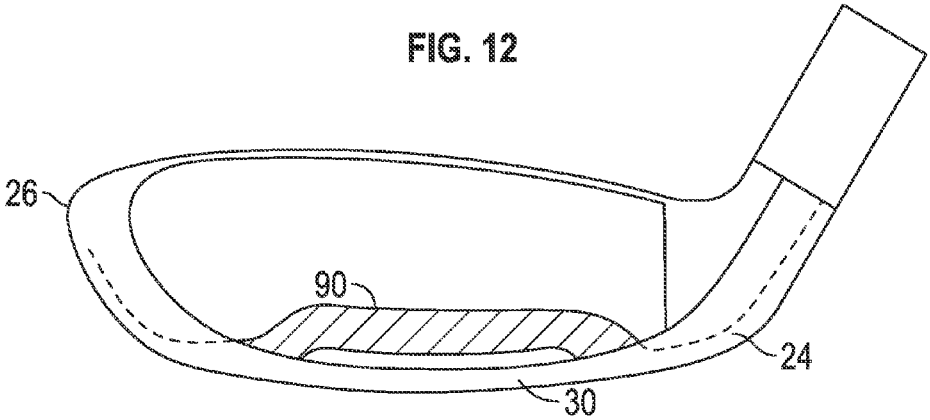
FIG. 13 is a front plan view of the embodiment shown in FIG. 12 without the face component.
Figure 14:
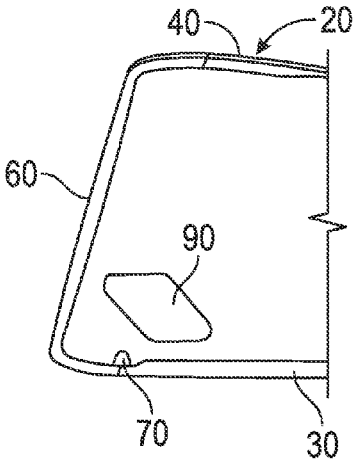
FIG. 14 is a cross-sectional view of the embodiment shown in FIG. 12 along lines 14-14.

In an alternative embodiment, shown in FIGS. 12-14, the weight bar 90 is affixed to the sole 30 at only two places, one near the heel side 24 of the body 20 and one near the toe side 26 of the body, effectively bridging most of the sole 30. In this and the embodiments shown in FIGS. 9-10, the weight bar 90 may have any cross-sectional shape, including the triangular weight bar 90 structure shown in FIG. 10, the quadrilateral weight bar 90 structure shown in FIG. 14, and the trapezoidal weight bar 90 structure shown in FIG. 16. Portions of the weight bar 90 may be made from different materials to further customize the golf club head 10 and adjust the CO location.

Figure 24:
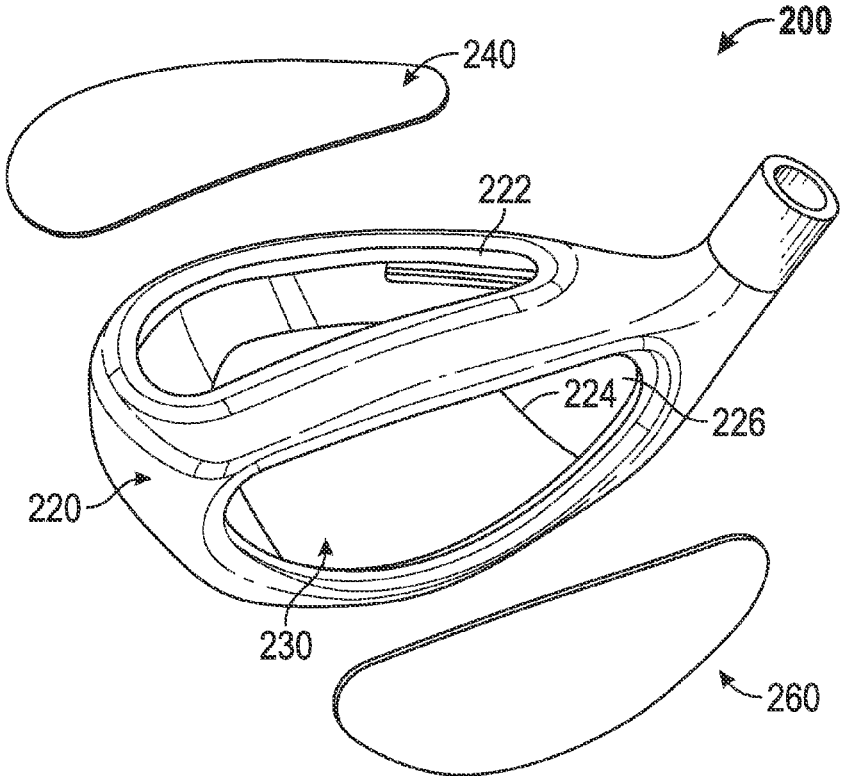
FIG. 24 is an exploded view of a multi-piece golf club head structure configured to house any of the embodiments disclosed herein.
Figure 25:
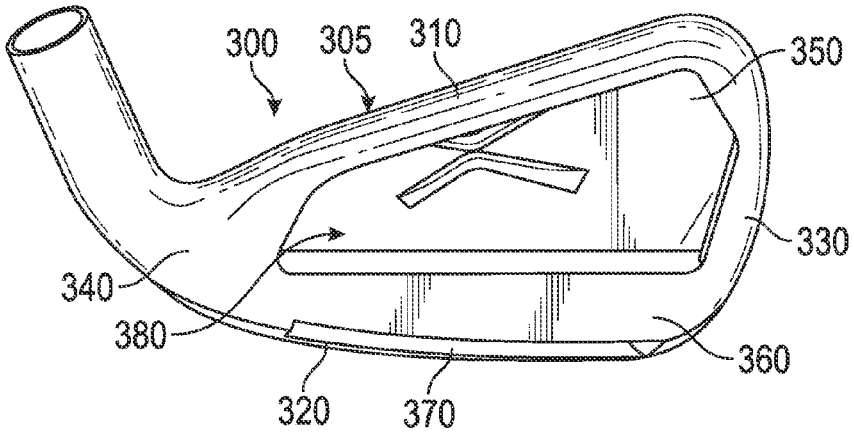
FIG. 25 is a rear perspective view of a tenth embodiment of the present invention.
Figure 26:
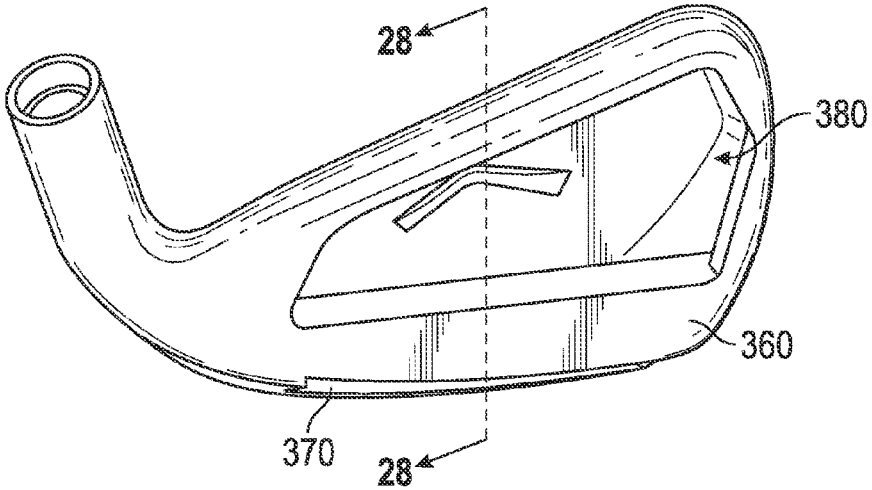
FIG. 26 is another rear perspective view of the embodiment shown in FIG. 25.
Figure 27:
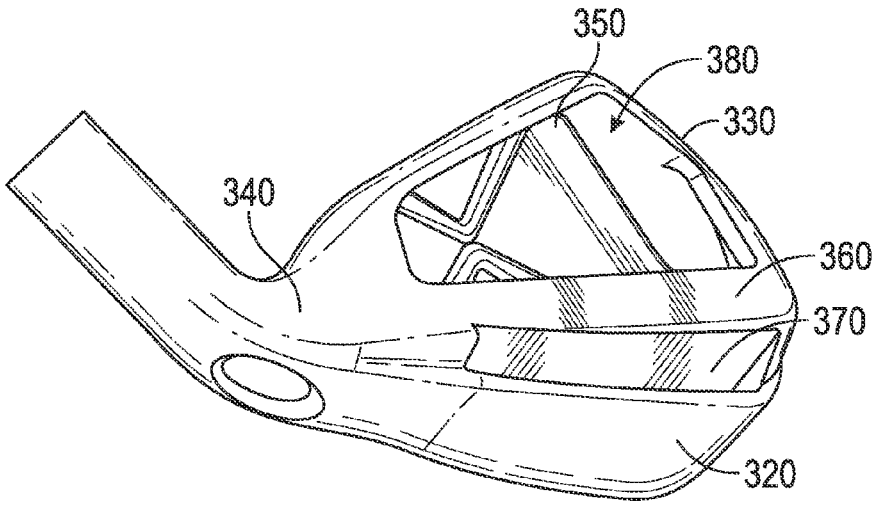
FIG. 27 is a sole perspective view of the embodiment shown in FIG. 25.
Figure 28:
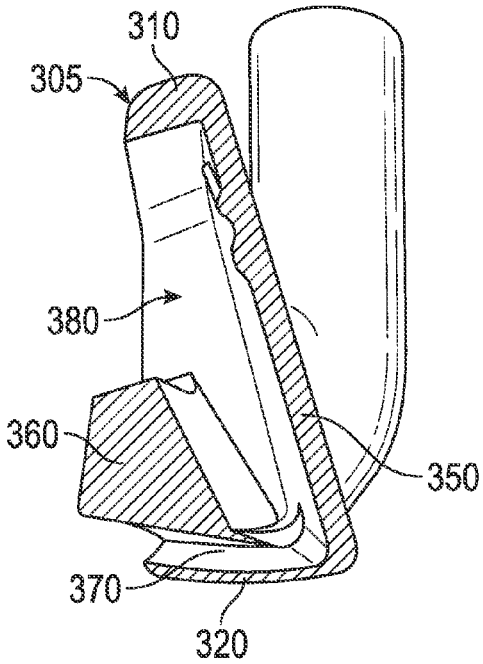
FIG. 28 is a cross-sectional view of the embodiment shown in FIG. 26 along lines 28-28.

As shown in the Figures, the face component 60 of the present invention may take different forms and structures to maximize the striking area of the striking face 62, optimize return in small volume golf clubs like fairway woods and hybrids, and increase performance characteristics such as characteristic time (CT) and coefficient of resistance (COR). In particular, the face component 60 may include a return portion 64 that fully or mostly encircles the striking face 62, forming a face cup, or the return portion 64 may only extend from a portion of the striking face 62, e.g., from the toe, heel, crown, and/or sole edges 61, 63, 65, 67 of the striking face 62. For example, the face component 60 shown in FIGS. 1, 4, 6, 8, and 12 has a return portion 64 that extends from the toe, crown, and sole edges 61, 65, 67 of the striking face 62 but not from the heel edge 63, forming a partial face cup. In the embodiment shown in FIG. 24, the face component 60 may include nothing but the striking face 62, with no return portion 64.

Figure 15:
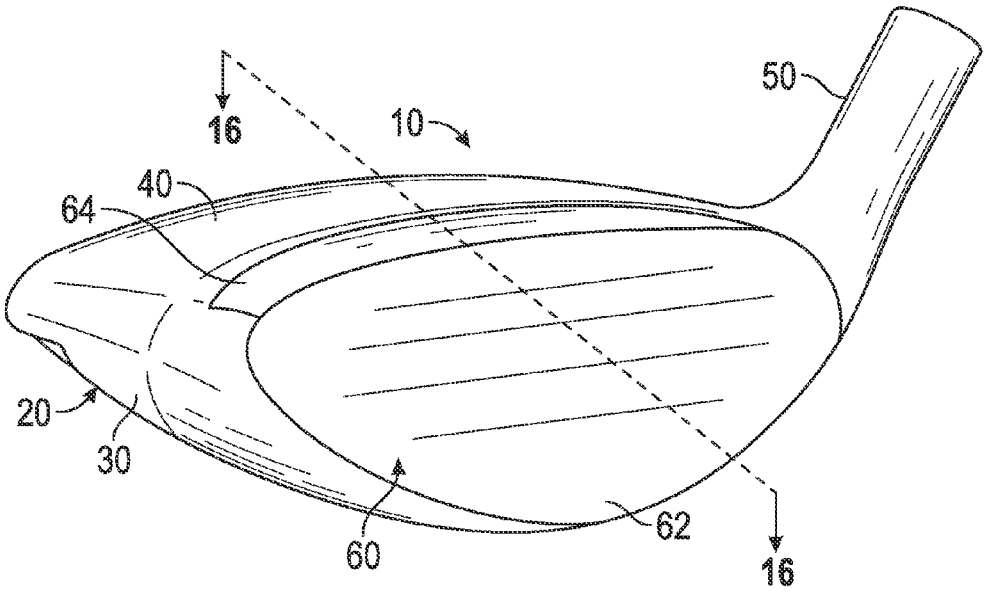
FIG. 15 is a front perspective view of a sixth embodiment of the present invention.
Figure 16:
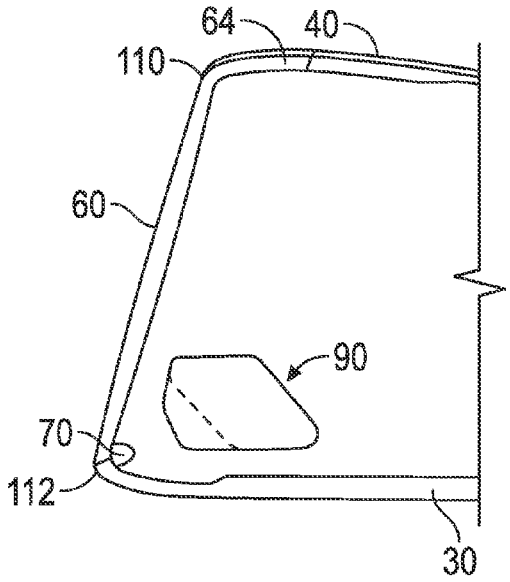
FIG. 16 is a cross-sectional view of the embodiment shown in FIG. 15 along lines 16-16.
Figure 17:
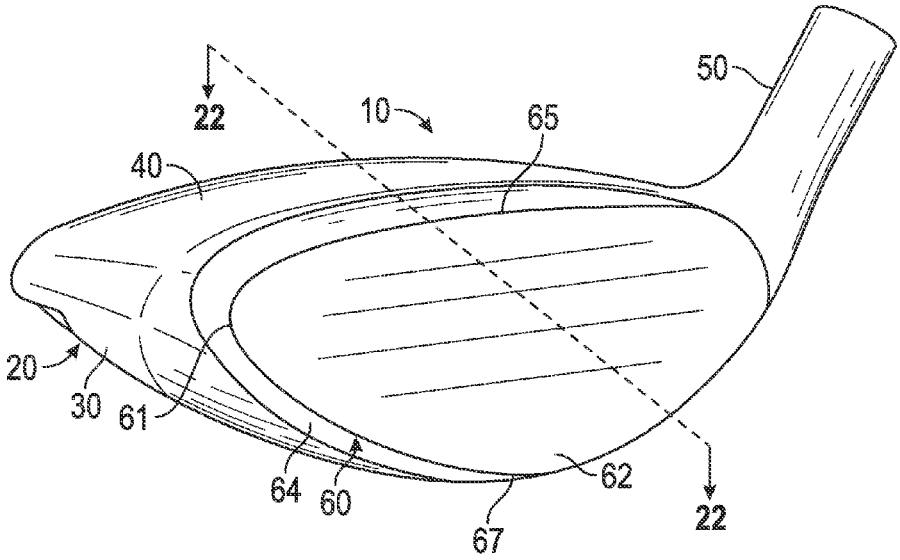
FIG. 17 is a front perspective view of a seventh embodiment of the present invention.
Figure 18:
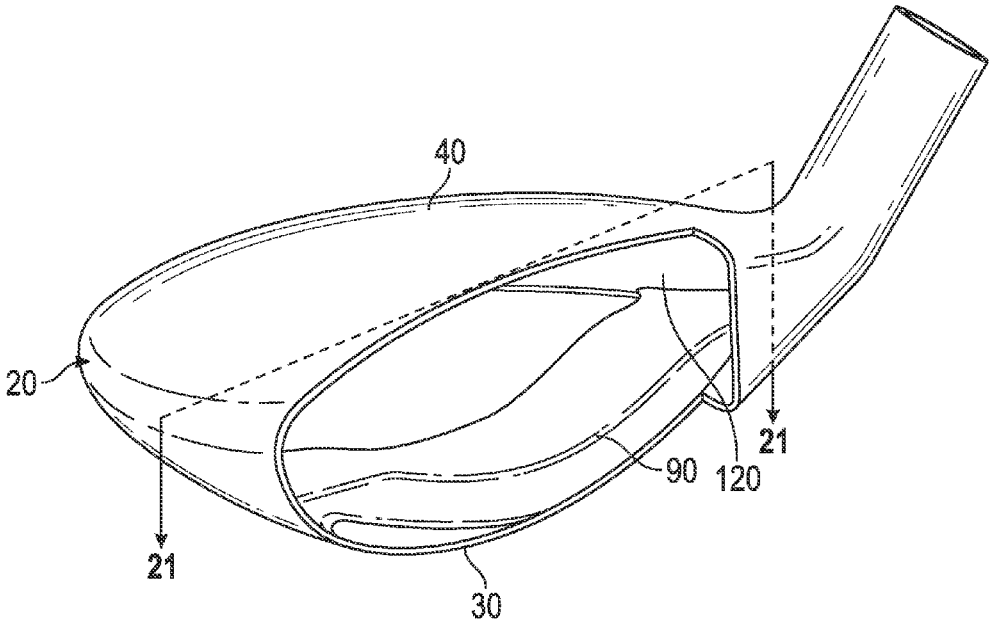
FIG. 18 is a left side perspective view of the embodiment shown in FIG. 17 without the face component.
Figure 19:
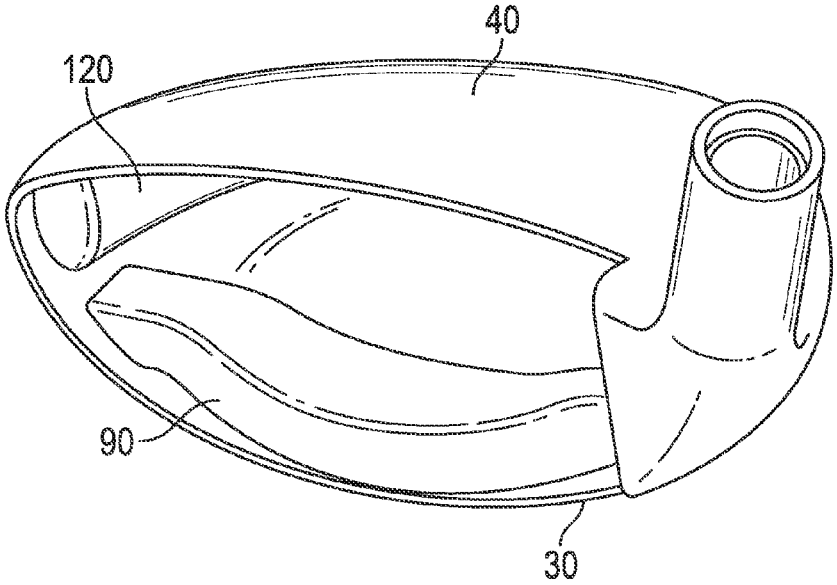
FIG. 19 is a right side perspective view of the embodiment shown in FIG. 17 without the face component.
Figure 20:
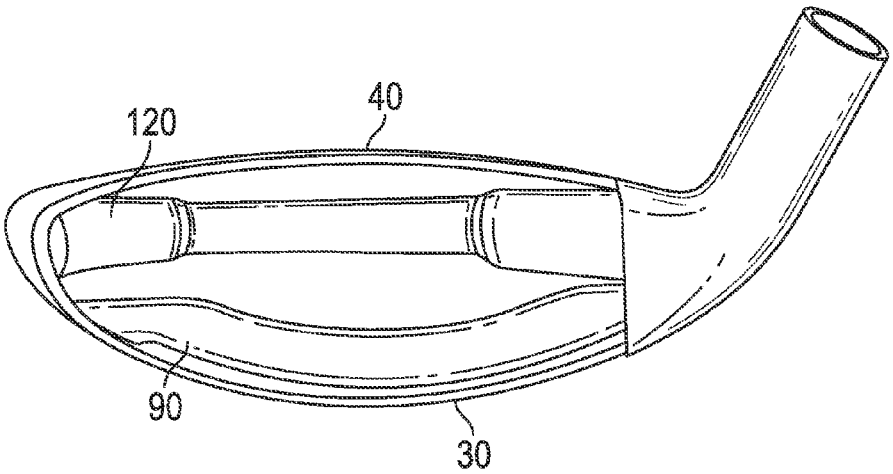
FIG. 20 is a front perspective view of the embodiment shown in FIG. 17 without the face component.
Figure 21:
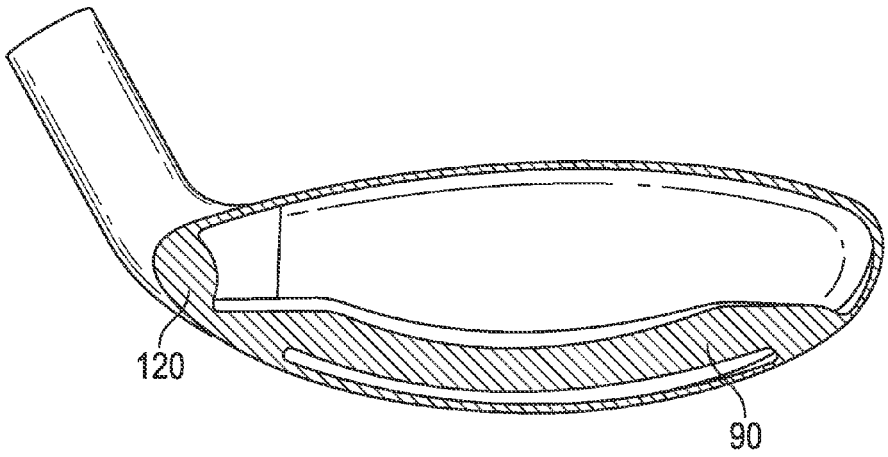
FIG. 21 is a cross-sectional view of the embodiment shown in FIG. 18 along lines 21-21.
Figure 22:
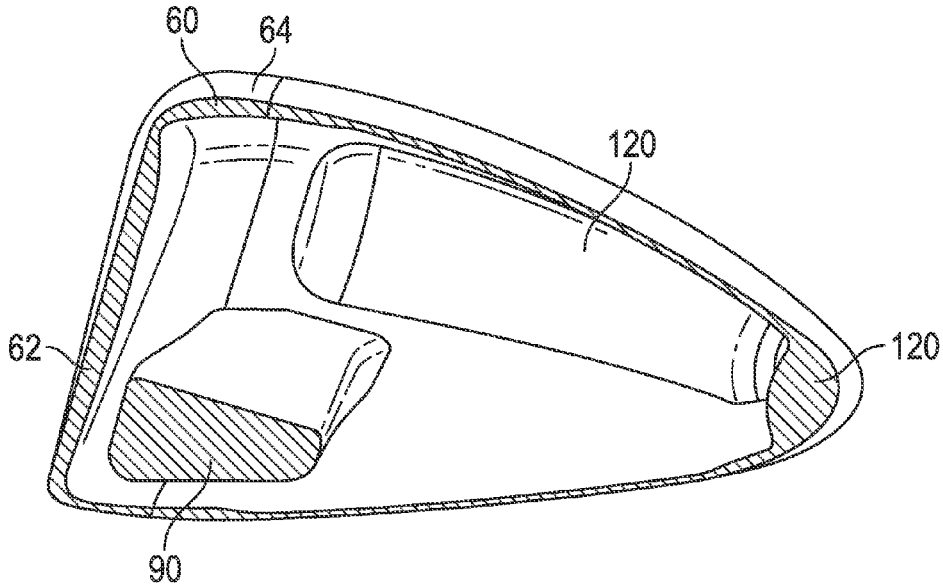
FIG. 22 is a cross-sectional view of the embodiment shown in FIG. 17 along lines 22-22.

As shown in FIGS. 15 and 16, in another embodiment the face component 60 has an "r" shaped configuration, with a return portion 64 extending from the crown side of the striking face 62 but nowhere else. In this way, the weld seam 70 is moved away from the striking face 62 at the crown junction 110, but remains at the sole, toe, and heel junctions 112, 114, 116 of the striking face 62, which reduces stress at the crown junction while still maintaining high COR and CT values. The weld seam 70 also may be non-planar.

In other embodiments, the golf club head 10 may include an additional weight structure. For example, the embodiment shown in FIGS. 17-22 includes a weight bar 90 extending from the heel side 24 of the sole 30 to the toe side 26 of the sole 30, a face component 60 having return portions 64 extending from the crown, sole, and toe edges 65, 67, 61, and an internal weight band 120 extending along most of the junction between the sole 30 and the crown 40 inside the cavity 22 of the golf club head 10. This construction allows the club to have both desired mass and thin sole 30 and crown 40 portions, thus increasing the compliance of the striking face 62 and optimizing CO.

Figure 23A:
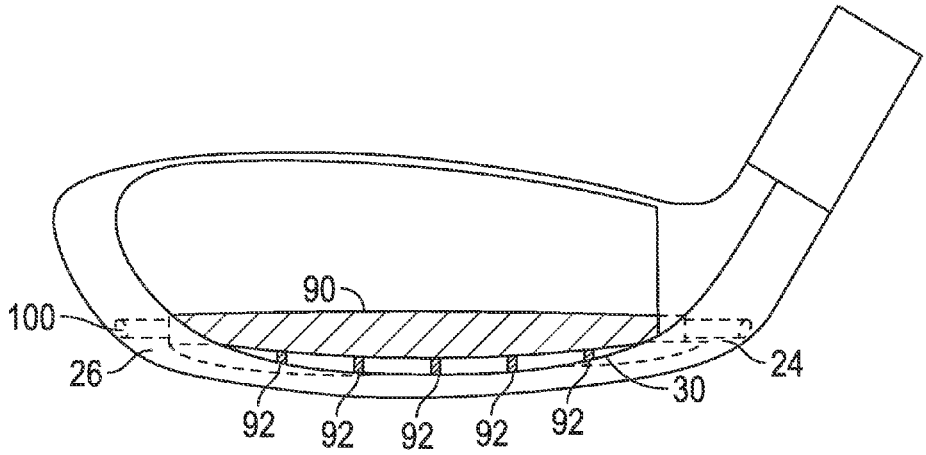
FIG. 23A is a front perspective view of an eighth embodiment of the present invention.
Figure 23B:
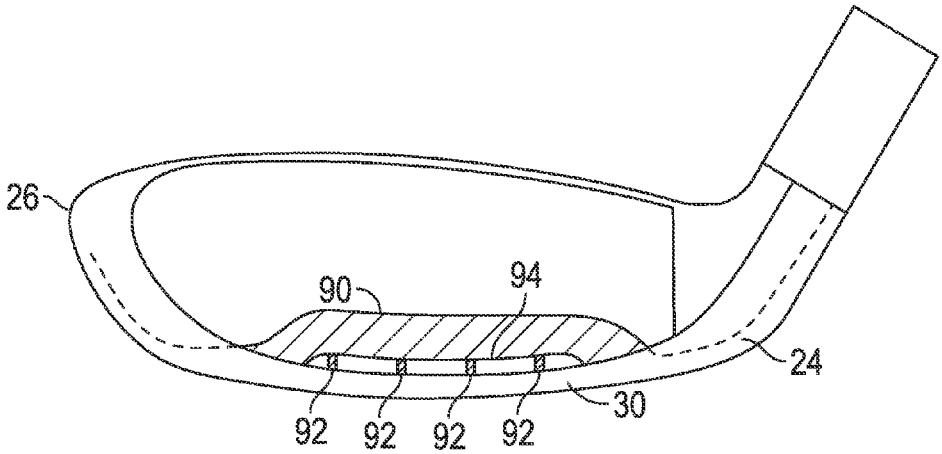
FIG. 23B is a front perspective view of a ninth embodiment of the present invention.

For each of the weight bar 90 embodiments disclosed herein, the weight bar 90 may be supported with one or more pins 92, shown in FIGS. 23A and 23B, which are affixed to the sole 30 within the cavity 22 of the golf club head 10 and connect with a bottom surface 94 of the weight bar 90 and/or a rear surface (not shown) of the weight bar 90. The pins preferably are separate pieces composed of a strong, lightweight material such as plastic or composite no that their presence does not detract from the mass configuration created by the weight bar 90, but in some embodiments may be integrally formed with the sole 30 and the weight bar 90 itself.

For all embodiments disclosed herein, the face component 60 preferably is composed of a high-strength, high performance material to minimize the detrimental influence of weld location on performance. The face component 60 preferably is constructed so that the striking face 62 has a maximum CT of 235-260 at its geometric center 68, and a CT of 205-260 at all points located approximately 0.25 inch from the geometric center, and at least at the high center and low center points on the striking face 62.

Each of the embodiments of the weight lip 80 and weight bar 90 disclosed herein may be incorporated into the four piece, multi-material golf club head 200 structure shown in FIG. 16 to better configure mass properties and performance characteristics such as CT and COR. This structure can be used with wood-type and hybrid-type golf club heads. In one embodiment of this golf club head 200, the golf club head 200 includes a body 220 formed of a material having a lower density than steel, the material being both castable and weldable, the body 220 haying a crown opening 222, a sole opening 224, and a face opening 226. A sole 230 composed of a steel material, or a denser material than steel, is then welded or brazed to the body 220, closing off the sole opening 224. A lightweight crown 240 composed of low-density carbon or a thin, strong, lightweight metal is then affixed to the body 220, closing the crown opening 222, and a face plate 260 composed of a high strength material is welded or brazed to the body 220, closing the face opening 226. This multi-material embodiment contributes to optimized center of gravity location, which is particularly useful in fairway woods. The face opening 226 and face plate 260 preferably include joint locations that are optimized for minimum interference with the striking surface and flexing regions of the body 220.

In another embodiment, the golf club head 200 shown in FIG. 16 has a material composition that contributes to optimized moment of inertia values, which is particularly useful in hybrids. In this embodiment, the body 220 is composed of a material having a higher density than steel, the material being both castable and weldable, the sole 230 is composed of a steel material or a denser material and is welded or brazed to the body 220, the crown is 240 is composed of a low-density carbon material and is bonded to the body 220, and the face plate 260 is composed of a high strength material and is welded or brazed to the body.

The weight bar 90 configurations disclosed with the embodiments herein can also be used with an iron-type golf club head as shown in FIGS. 25-28. In this preferred embodiment of the present invention, the iron-type golf club head 300 comprises a body 305 having a top line 310, a sole 320, a toe side 330, a heel side 340, and a rear cavity 380, a face component 350, and a weight bar 360. The weight bar 360 bridges the sole 320, forming a narrow slot 370 between the weight bar 360 and the sole 320 and providing room for the face component 350 to deflect downward when the golf club head 300 makes contact with a ball. One or more pins 92, examples of which are shown in FIGS. 23A and 23B, can be disposed within the slot, between the weight bar 360 and the sole 320, to provide additional support to the weight bar 360. In alternative embodiments, the weight bar 360 may be rotatable within the rear cavity 380 as disclosed in connection with other embodiments herein, and the golf club head 300 may be made of multiple materials, such as different types of steel. The weight bar 360 may be composed of multiple materials in order to affect mass properties of the golf club head 300, and may have any cross-sectional shape, including the ones disclosed in connection with other embodiments of the present invention.

In the preferred embodiment, the face component 350 is a face insert, hut in other embodiments it may be a face plate or even a face cup. As shown in FIGS. 25-28, the face component 350 preferably has a striking surface with a variable thickness pattern, which may be any pattern disclosed in U.S. Pat. Nos. 7,137,907, 7,101,289, 7,258,626, 7,422,528, 7,448,960, 7,713,140, 8,012,041, and 8376876, the disclosure of each of which is hereby incorporated by reference in its entirety herein, and U.S. Patent Publication Number 20120021849, the disclosure of which is also hereby incorporated by reference in its entirety herein.

In each of the embodiments disclosed herein, the inertia of the weight lip 80 or weight bar 90 during impact of the golf club head 10 with a ball improves sole 30 compliance by enhancing the bending capabilities of thinner regions of the sole 30. The weight construction shown in these Figures also allows the face component 60 to have a face cup (a return portion 64 extending part or completely around the periphery of the striking face 62) construction without sacrificing an optimized center of gravity location, and also allows the manufacturer of the club head 10 to take weight away from, and thus thin out, the sole 30, which allows the sole 30 to flex and bend more easily and thus contribute more to performance of the face component 60.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An iron-type golf club head comprising:

a body comprising a top line, a sole, a heel side, a toe side, and a rear cavity;

a weight bar comprising a first end and a second end; and a face component, wherein the weight bar is disposed within the rear cavity proximate the face component, wherein the first end is connected to the heel side of the body, wherein the second end is connected to the toe side of the body, wherein the weight bar does not make contact with the face component and does not make contact with the sole, and wherein the weight bar bridges the entire sole.

2. The iron-type golf club head of claim 1, wherein the weight bar is rotatably connected to the body.

3. The iron-type golf club head of claim 2, wherein the weight bar comprises a pin portion and a weight portion, wherein the pin portion comprises a heel side end and a toe side end, and wherein the weight portion is asymmetrically disposed on the pin portion.

4. The iron-type golf club head of claim 3, wherein the pin portion and the weight portion are not integrally formed.

5. The iron-type golf club head of claim 1, wherein the weight bar comprises at least two different materials having different densities.

6. The iron-type golf club head of claim 1, wherein the face component is selected from the group consisting of a face plate and a face insert.

7. The iron-type golf club head of claim 1, wherein the face component is integrally formed with the body.

8. The iron-type golf club head of claim 1, wherein a slot is disposed between the weight bar and the sole.

9. The iron-type golf club head of claim 1, wherein the face component comprises variable thickness.

10. The iron-type golf club head of claim 1, wherein the weight bar has a cross-sectional shape selected from the group consisting of triangular, parallelogram, and trapezoidal.

11. An iron-type golf club head comprising:

a face component;

a body comprising a top line, a sole, a hosel, and a perimeter weighting element; and a weight bar comprising a first end and a second end, wherein the perimeter weighting element comprises a top side, a sole side, a heel side, and a toe side, wherein the perimeter weighting element forms a rear cavity, wherein the weight bar is disposed proximate the rear cavity without making contact with the face component and without making contact with the sole, and wherein the first end of the weight bar is affixed to the heel side of the perimeter weighting element and the second end of the weight bar is affixed to the toe side of the perimeter element such that the weight bar bridges the entire sole side and forms a slot proximate the sole.

12. The iron-type golf club head of claim 11, wherein the face component is selected from the group consisting of a face plate and a face insert.

13. The iron-type golf club head of claim 11, wherein the face component comprises variable thickness.

14. The iron-type golf club head of claim 11, wherein the body is composed of a first steel material.

15. The iron-type golf club head of claim 14, wherein the face component is composed of a second steel material that differs from the first steel material.

16. The iron-type golf club head of claim 11, wherein the weight bar is integrally formed with the body.

17. The iron-type golf club head of claim 11, wherein the weight bar is composed of a plurality of materials.

18. The iron-type golf club head of claim 17, wherein at least one of the plurality of materials is a tungsten alloy.

19. The iron-type golf club head of claim 11, wherein the weight bar has a cross-sectional shape selected from the group consisting of triangular, parallelogram, and trapezoidal.

20. An iron-type golf club head comprising:

a face component;

a body comprising a top line, a sole, a hosel, and a perimeter weighting element;

a plurality of pins; and a weight bar comprising a first end and a second end, wherein the perimeter weighting element comprises a top side, a sole side, a heel side, and a toe side, wherein the perimeter weighting element forms a rear cavity, wherein the weight bar is disposed proximate the rear cavity without making contact with the face component, wherein the first end of the weight bar is affixed to the heel side of the perimeter weighting element and the second end of the weight bar is affixed to the toe side of the perimeter element such that the weight bar bridges at least part of the sole side and forms a slot proximate the sole, wherein each of the plurality of pins is disposed within the slot and extends between the sole and the weight bar.

* * * * *